US008745924B2

(12) United States Patent
Tshai

(10) Patent No.: US 8,745,924 B2
(45) Date of Patent: Jun. 10, 2014

(54) AUTOMATIC DOOR BOTTOM WITH RELEASE MECHANISM

(75) Inventor: Adi Tshai, Elmhurst, NY (US)

(73) Assignee: Zero International, Inc., New York ( * ) Notice: Subject to any disclaimer, the term of this patent is extended or adjusted under 35 U.S.C. 154(b) by 932 days.

(21) Appl. No.: 12/283,442

(22) Filed: Sep. 12, 2008

(65) Prior Publication Data

US 2009/0077895 A1 Mar. 26, 2009

Related U.S. Application Data

(60) Provisional application No. 60/995,659, filed on Sep. 26, 2007.

(51) Int. Cl.
*E06B 7/28* (2006.01)

(52) U.S. Cl.
USPC ..... 49/316; 49/303; 49/306; 49/310

(58) Field of Classification Search
USPC ..... 49/303, 306, 307, 308, 309, 310, 311, 49/312, 316
See application file for complete search history.

(56) References Cited

U.S. PATENT DOCUMENTS

| | | | | | |
|---|---|---|---|---|---|
| 813,268 | A | * | 2/1906 | Woodburn | 49/308 |
| 814,076 | A | * | 3/1906 | Pike | 49/306 |
| 1,443,295 | A | * | 1/1923 | Tripp | 49/307 |
| 1,736,693 | A | * | 11/1929 | Behen | 49/308 |
| 1,853,338 | A | * | 4/1932 | Dennis | 49/309 |
| 2,033,241 | A | * | 3/1936 | Hawk | 49/310 |
| 4,406,088 | A | * | 9/1983 | Berndt, Jr. | 49/309 |
| 4,947,584 | A | | 8/1990 | Wexler | |
| 6,125,584 | A | | 10/2000 | Sanders | |
| 2004/0010973 | A1 | | 1/2004 | Lio et al. | |

* cited by examiner

*Primary Examiner* — Gregory J Strimbu
(74) *Attorney, Agent, or Firm* — Fitzpatrick, Cella, Harper & Scinto

(57) ABSTRACT

An automatic door bottom having a release mechanism is used on the bottom of a hinged door that is pivotable to be positioned over a sill when closed and includes a movable sealing member having a length corresponding to the width of the door and is housed in a channel mounted on the door. The sealing member is movable vertically downwardly into a sealing position in which the sealing member will contact the door sill when the door is closed. The release mechanism permits the sealing member to be moved upwardly even when the door is in the closed position.

14 Claims, 16 Drawing Sheets

FIG. 2
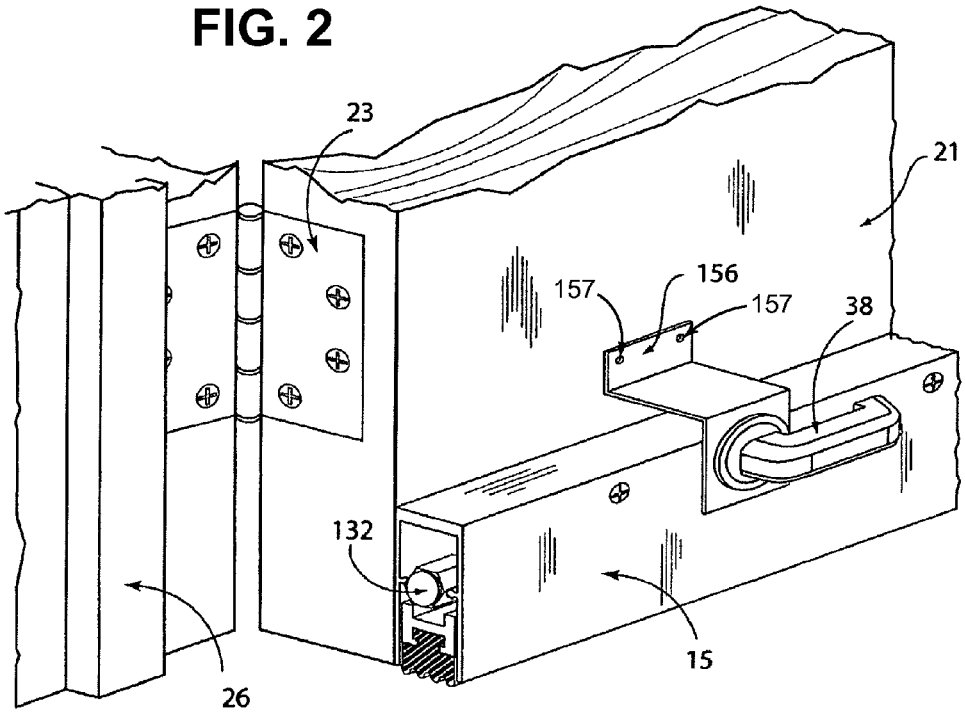
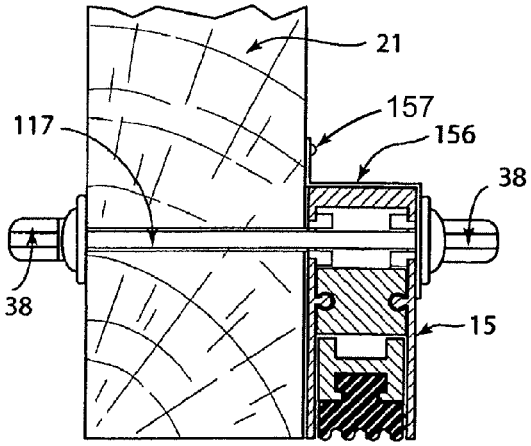
FIG. 3
FIG. 4
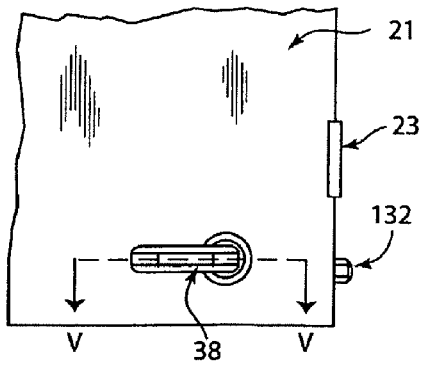

FIG. 7
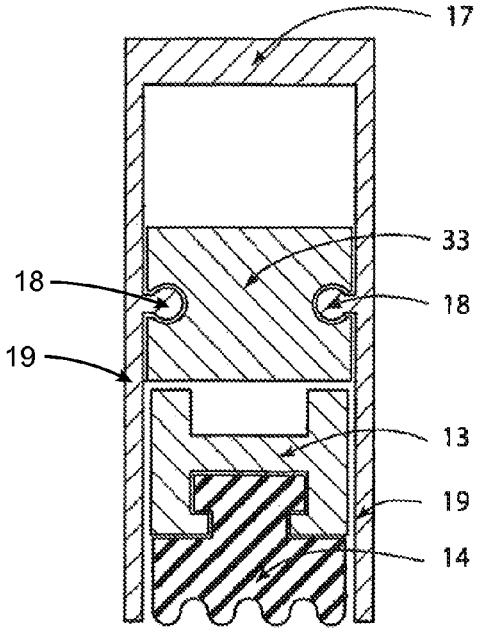
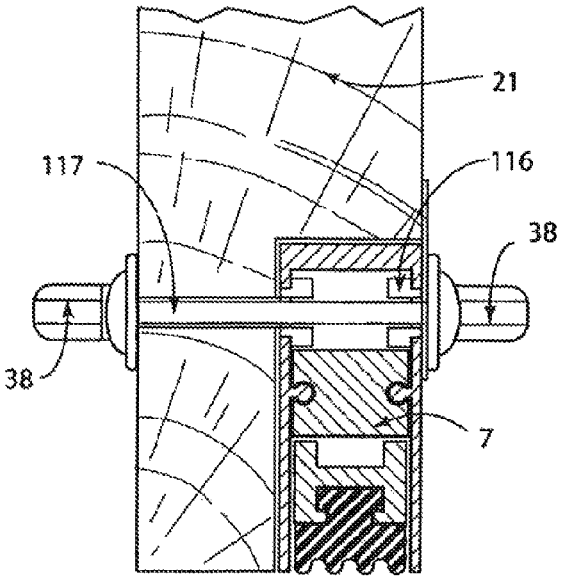
FIG. 8
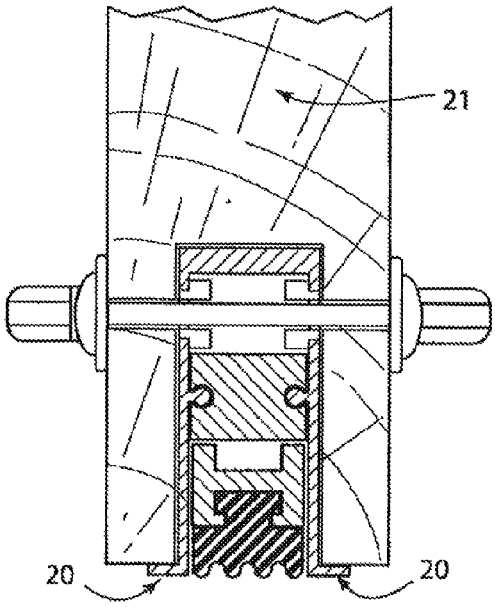
FIG. 9

AUTOMATIC DOOR BOTTOM WITH RELEASE MECHANISM

This application claims the benefit of U.S. Provisional Patent Application No. 60/995,659, filed Sep. 26, 2007.

BACKGROUND OF THE INVENTION

Field of the Invention

This invention relates to an automatic door bottom with a release mechanism. An automatic door bottom is a device attached to bottom part of a door by mounting means, for example by screws. The terms Automatic Door Bottom and Door Bottom will be used interchangeably in the description of this invention.

The current invention allows a person to selectively seal or unseal a door bottom when said door is in the closed state. Said release mechanism to the automatic door bottom may be actuated remotely or in close proximity. The mechanism utilized to release the automatic door bottom may be through mechanical force or electrical forces.

A door is described as an enclosure of an opening. The perimeter of the opening around the door on the left and right vertical sides are referred as jambs. The part of the floor bellow the bottom part of the door is referred as a door sill. The term swing door as used herein describes a door which is pivotally mounted to one of the jambs by mounting means generally referred as hinges. The side of the door nearest to the hinges is referred as the hinged side, the side farthest from the hinges is referred as the unhinged side. The opening and closing of said door occurs by moving the door in a swinging action around the hinges. A gap generally exists between the bottom part of the door and the adjacent sill when the door is in its closed position.

The Automatic Door Bottom of the present invention has a housing in the form of an inverted U shaped channel with an open bottom facing toward the door sill and has a length corresponding to the door width. The Automatic Door Bottom has at least one sealing member installed at the open bottom of said channel.

A displacement mechanism is coupled to the sealing member at one or multiple points to actuate the sealing member and move it from an extended to a retracted position relative to the bottom of the door. The displacement mechanism has at least one operating member and at least one resilient member. The at least one operating member cooperates with at least one stationary abutment around the perimeter of the door to operate the displacement mechanism, and displace the sealing member to move it to its extended position. A release mechanism is also provided that is activated by other means of actuation to selectively disengage the displacement mechanism from actuating the sealing member even when the door is closed.

The sealing member in this invention consists of a compressible and elastic sealing element and a generally H-shaped rigid member to support the sealing element. The sealing member can be reciprocally lowered, i.e. extended, in to a first sealing position and retracted into the channel in a second unsealing position. The first and second position correspond respectively to a closed and an opened door position. The purpose for providing the sealing position is in general to block drafts, light, noise, and foreign objects from passing through the gap between the bottom edge of the door and the sill.

Furthermore the described reciprocal action creates a first correlation of a closed door correlated to a sealed gap, and a second correlation of an opened door correlated to an unsealed gap. An Automatic Door Bottom with release mechanism in this invention creates a third correlation where a closed door may also correlate to an unsealed gap.

BRIEF DESCRIPTION OF DRAWING

FIG. 2 is a partial perspective view of the door of FIG. 1 showing the door slightly open, and showing the bottom part of the door at the hinged side.

FIG. 3 is side cross section view taken along line III-III of FIG. 1.

FIG. 4 is an elevation view of the other side of the door from that shown in FIG. 2, showing one side of a foot operated lever as an actuator for release mechanism.

FIG. 7 is a general cross section view similar to FIG. 3 showing the channel of the Automatic Door Bottom.

FIG. 8 is a view similar to FIG. 3, illustrating a modified version of an embodiment of the invention with the Automatic Door Bottom flush mounted to the door leaf.

FIG. 9 is a view similar to FIG. 3, illustrating a modified version of another embodiment of the invention with the Automatic Door Bottom mortise mounted to the door.

DETAILED DESCRIPTION OF PREFERRED EMBODIMENTS

The contents of U.S. Pat. No. 4,947,584, U.S. Pat. No. 6,125,584, and U.S. Pat Application No. 20040010973 are incorporated hereby in their entirety by reference.

Figure 1:
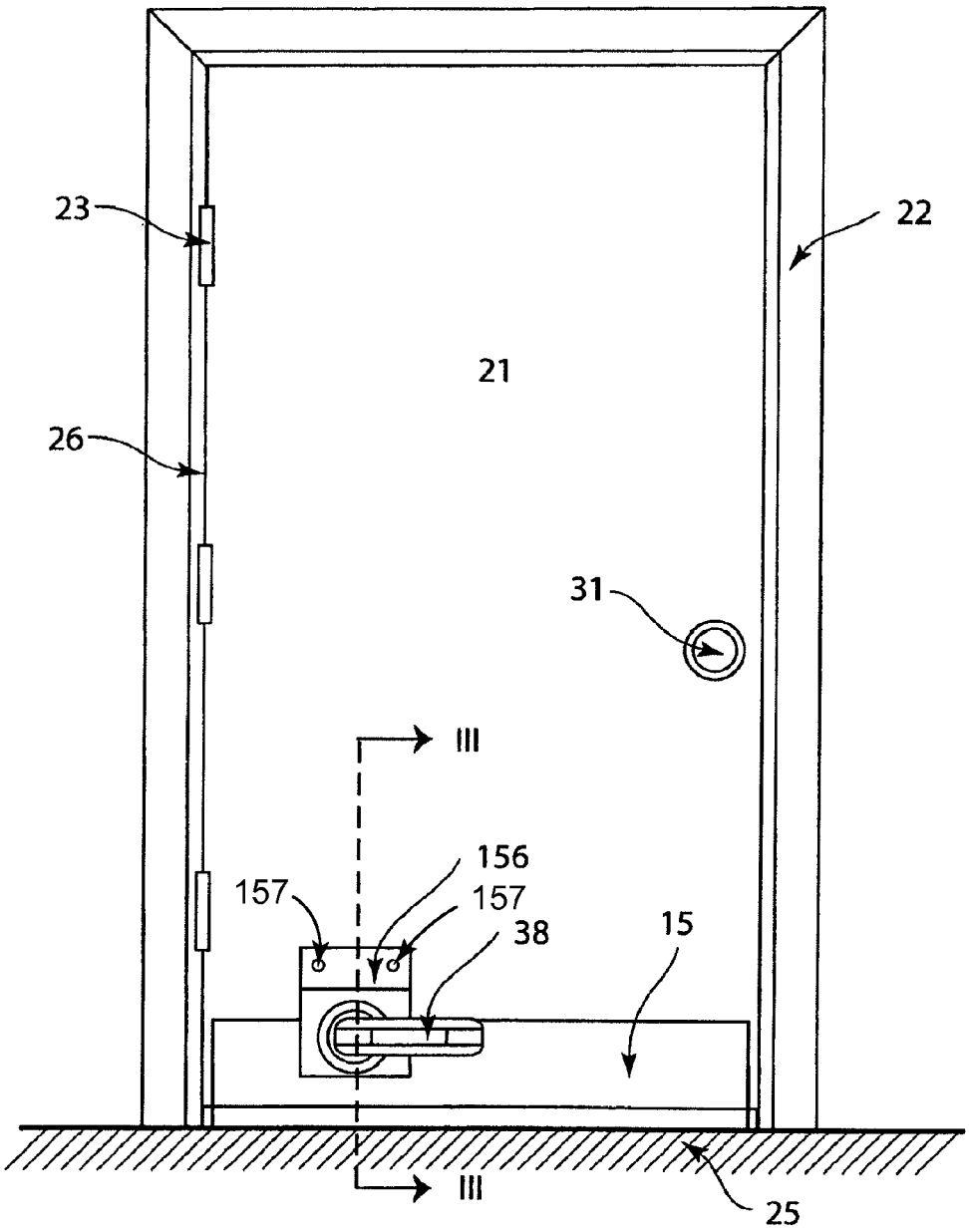
FIG. 1 is an elevation view of an Automatic Door Bottom with release mechanism according to the first embodiment of the invention mounted on a closed swing door.

FIG. 1 shows the preferred first embodiment of the invention which is a front view of a swing door 21 in its closed position, mounted to a door jamb 26 by means of hinges 23. The door 21 is provided with door knob 31 which operates a spring loaded latch (not shown in the figure). An alternative for door knob 31, for example a hand lever, can also be used, but is not shown. An Automatic Door Bottom with release mechanism 22 can be surface mounted on the door or inserted in a hollow in the bottom portion of said door, with two foot operated levers 38, to operate the release mechanism. Preferably, at least one lever 38 is mounted to the door by mounting plate 156. Alternatively any form of switching mechanism commonly known to persons skilled in the art may be used, including but not limited to a push button mechanism, upwardly moving latch, laterally moving latch, or a pulling mechanism. FIG. 4 shows the preferred embodiment with the lever on the other side of the door shown in FIG. 1. The operation of levers 38 are a clockwise turn in FIG. 1 and a counterclockwise turn in FIG. 4. FIG. 3 is a side cross sectional view along line III-III of FIG. 1, showing the connection between the bottom of door 21 and lever 38 by a spindle 117. FIG. 2 is a perspective view of the door of FIG. 1, showing the partially opened door with a more detailed view of the Automatic Door Bottom at the hinge side of the door.

Figure 5:
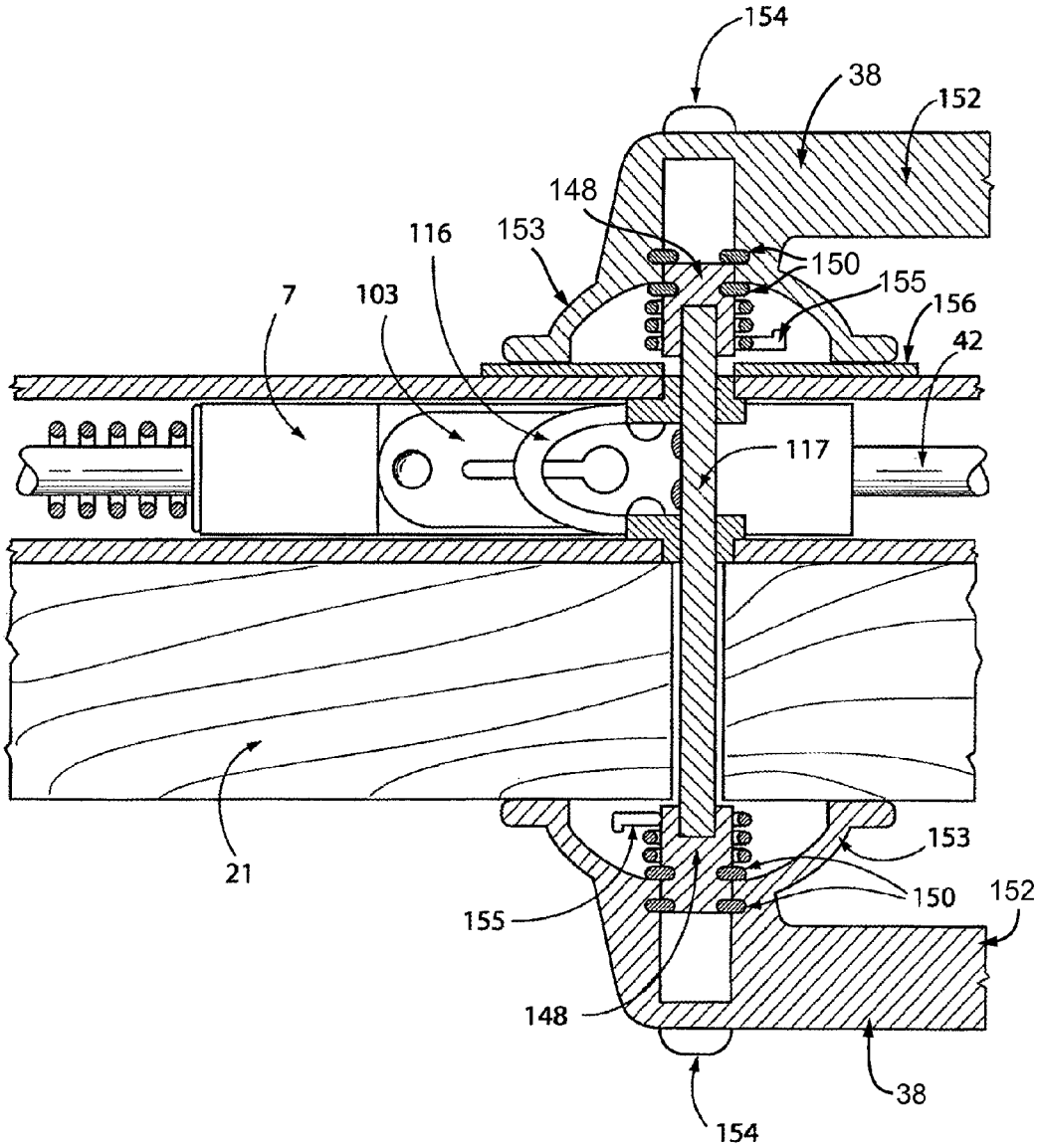
FIG. 5 is a plan, cross section view taken along line V-V in FIG. 4.

FIG. 5 is a plan cross section view along line V-V of FIG. 4, showing the detail relationship between the Automatic Door Bottom and levers 38. In the preferred embodiment levers 38 include a mirror image pair of lever handles 152, mounted to shafts 148 by means of screws 154. Each shaft 148 is held in place with a pair of washers 150 to the base plate 153. FIG. 4 shows the base plate 153 of lever 38 directly engaging the side of the door shown therein and FIG. 1 shows the base plates 153 on that side of the door indirectly mounted through mounting plate 156 by screws 157. Preferably torsional springs 155 are mounted at one end to each of the shafts 148 and at the other end to base plate 153. This enables levers 38 to spring back to their normal position shown in FIG. 1. In an alternative embodiment, the lever can move into various positions manually without the aid of any mechanical forces. The pair of levers 38 are connected to each other by a square shape spindle 117, and are connected to the release mechanism through a rocker element 116. The rocker 116 is preferably made from injection molding resilient plastic. All parts of the invention may be constructed from different types of materials commonly known to persons skilled in the art for their desired purpose.

FIG. 7 shows a general cross section view of one embodiment of channel 15, i.e., an extruded inverted U-shape with a length corresponding to the width of door 21. Channel 15 has top wall 17, a pair of legs 19 and, optionally, a pair of feet 20 as shown in FIG. 9. A pair of rails 18 are provided on the inside surfaces of legs 19 engaged in complementary grooves in one or more blocks referred to in FIG. 7 by numeral 33 to allow the blocks to move freely along the channel 15. Various blocks used in this invention have a cut out shape to accommodate rails 18, but can have different internal shapes and different numerical references are used herein for each shape depending on the block's functions. Alternatively, additional mechanisms may be inserted into a cavity formed by channel 15 if desired. Mechanisms such as a temperature sensor may be inserted into said cavity above the blocks to notify users of dangerous fire conditions.

Figure 6:
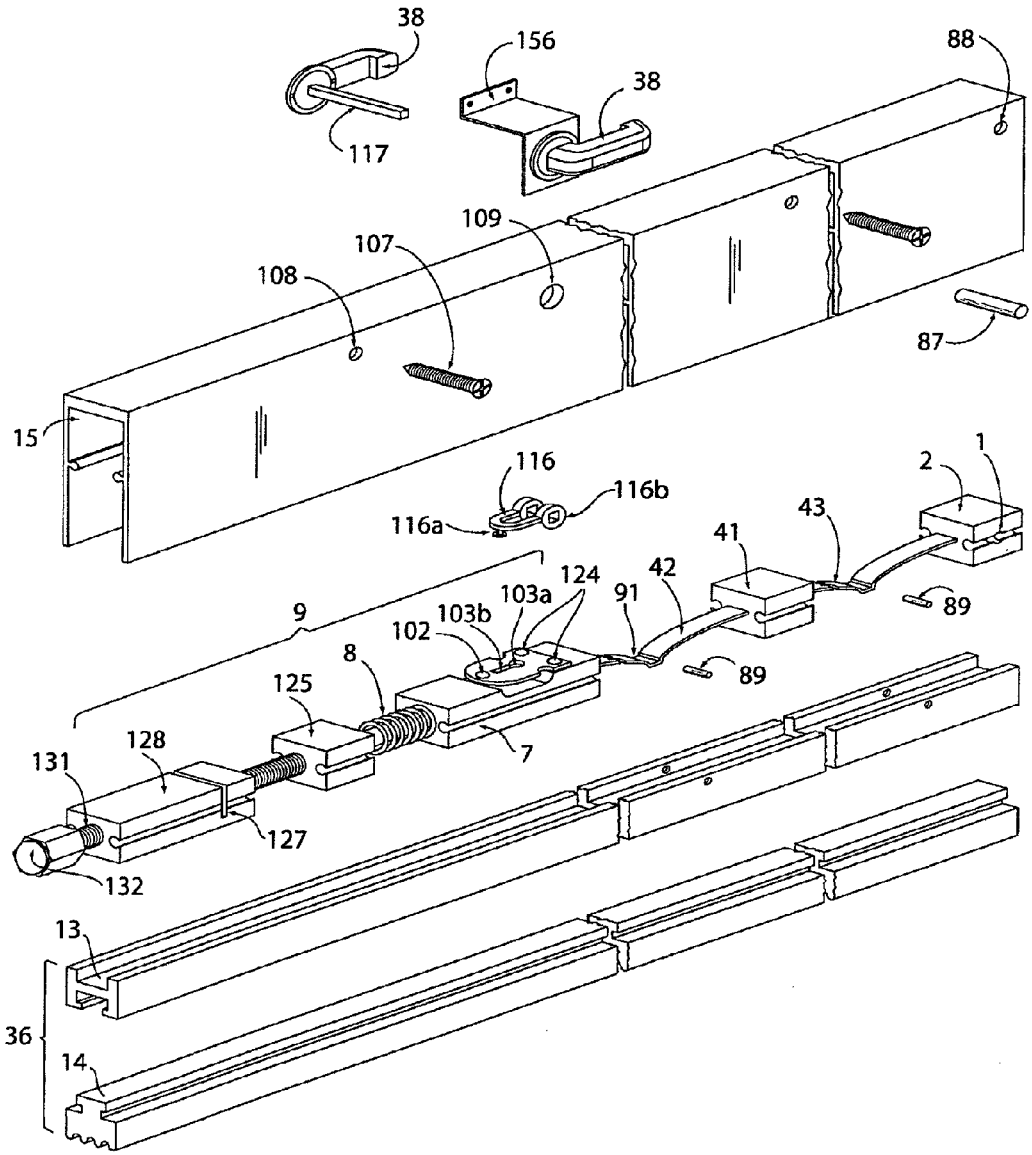
FIG. 6 is an exploded perspective view of the Automatic Door Bottom of FIG. 1 showing the components of the Automatic Door Bottom with release mechanism according to a first embodiment of the invention.

FIG. 6 is an exploded view of a first embodiment of the invention. The channel 15 is surface mounted to the door by means of mounting screws 107 through in line mounting holes 108, extending along the length of the Automatic Door Bottom. A pair of levers 38 are connected to channel 15 by spindle 117 through in line holes 109 on both side of legs 19 of the channel. Inside the channel 15, the spindle 117 pass thorough holes 116*b* of rocker 116. The rocker 116 is snapped in to in line holes 109 from inside the channel 15. A hook 116*a* is provided on the rocker to slide into a slot 103*b* through a hole 103*a*, formed in a leaf spring 103 to securely couple rocker 116 to the leaf spring as described hereinafter.

The displacement mechanism of the present invention consists of a release mechanism referred with numeral 9 and resilient members such as leaf springs 42 and 43. The leaf springs 42 and 43 are connected to each other by a connecting block 41. The other end of leaf spring 43 is secured in end block 2. The end block 2 is fixedly mounted to the channel 15, by a pin 87 that pass though in line holes 88 of channel 15 channel and hole 1 of end block 2.

The release mechanism 9 also includes a hollow block 128, adjustment block 125, and a housing block 7. The blocks mentioned above generally take shape of block 33, and are able to move freely along the channel 15 lengthwise.

A H-shape rigid housing 13 holds compressible sealing element 14 in place in the assembly. The sealing element has a shaped head which slides into and secures the sealing element to the housing 13 and it is fixed in place, for example, by adhesive or any form of mechanical mounting mechanisms commonly known to persons skilled in the art to form a two part sealing member 36. The displacement mechanism is connected to the sealing member 36, by mounting the middle sections of springs 42 and 43 beneath pins 89 which are mounted in through in line holes on the housing 13. The mounting is in such a way, that a limited movement of sealing member 36 lengthwise is permitted, but downward vertical movement across the width of channel downward is restricted by both leaf springs 42 and/or 43.

Figure 10A:
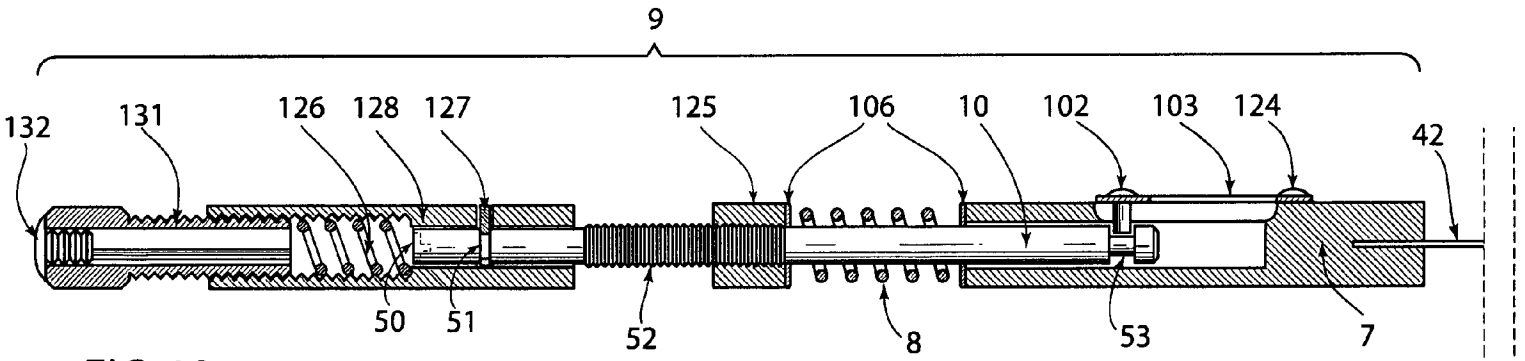
FIGS. 10*a*, 10*b*, and 10*c* together form a partial front view of the displacement mechanism of the first embodiment of the invention.
Figure 10B:
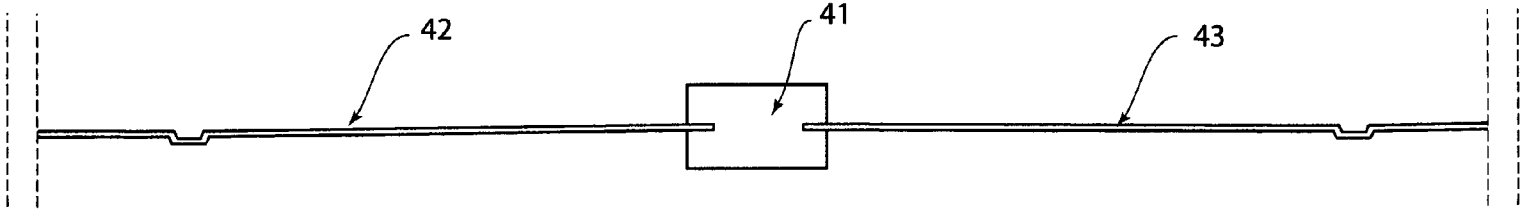
Figure 10C:
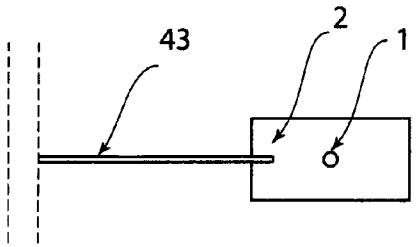

FIGS. 10*a*, 10*b*, and 10*c* are partial front views of the displacement mechanism of the Automatic Door Bottom with release mechanism according to the first embodiment of the invention. To form a complete figure, join the right side of FIG. 10A to the left side of FIG. 10*b*, and likewise join the right side of FIG. 10*b* to the left side of FIG. 10C. Tensional mechanisms such as, but not limited to, leaf springs may be used. Alternatively other forms of tensional mechanism may be utilized as commonly known to persons skilled in the art. Leaf springs 42 and 43 are provided as such that the spring constant of spring 42 is smaller than the spring constant of leaf spring 43. In FIG. 10A, the housing block 7 is joined directly with spring 42 as shown, or indirectly by another connecting block 41. The housing block 7 takes the general shape of block 33 as in FIG. 7, has a bore hole 7*a* at one end to accommodate a shaft 10, and an opening 7*b* in its top wall to provide a hollow middle section. The previously described leaf spring 103 is mounted to housing 7 by rivets 124 at one end, and has latch pin 102 in its other end to the left of slot 103*b* as seen in FIGS. 6 and 10*a*. The latch pin 102 extends from the end of leaf spring 103 into the hollow middle of housing 7 to latch shaft 10 by engagement in its annular grove or open cavity 53 formed therein.

Hollow block 128 has an interior threaded base which, in cooperation with a hollow adjustment cylinder 131, is used to adjust the length of operation of the displacement mechanism. An adjustment is executed by turning the head of cylinder 131, which preferably has a hexagonal shape. A spring 126 is provided to prevent accidental turning of cylinder 131.

Cushion 132 located at the left end of cylinder 131 is removably mounted in the bore formed in cylinder 131 to enable a screw driver to access a screw head 50 formed in the left end of shaft 10 as seen in FIG. 10*a*. The shaft 10 also has one annular grove 51 formed in its left end and is retained in block 128 by a retaining ring 127. A threaded area 52 is also provided on shaft 10 which is threaded into hollow block 125 which also has an interior threaded bore. A helical spring 8, assisted with a pair of washers 106, is situated between block 125 and housing 7. An operation of turning the screw head 50, in cooperation with the annular groove 153 being latched by latch pin 102, will cause hollow block 125 to move along threaded region 52, effectively adjusting the tension of helical spring 8.

FIGS. 11, 12, 13, and 14 show respectively operating stages one, two, three and four of the first embodiment of the invention. Stage one represents the condition of the Automatic Door Bottom when the door is in an open position, stage two represents its condition when the door is in an almost closed position. Stage three represents the condition of the Automatic Door Bottom with the door in its closed position, and stage four represents the door in its closed position with release mechanism activated to allow retraction of the sealing member 36.

Figure 11:
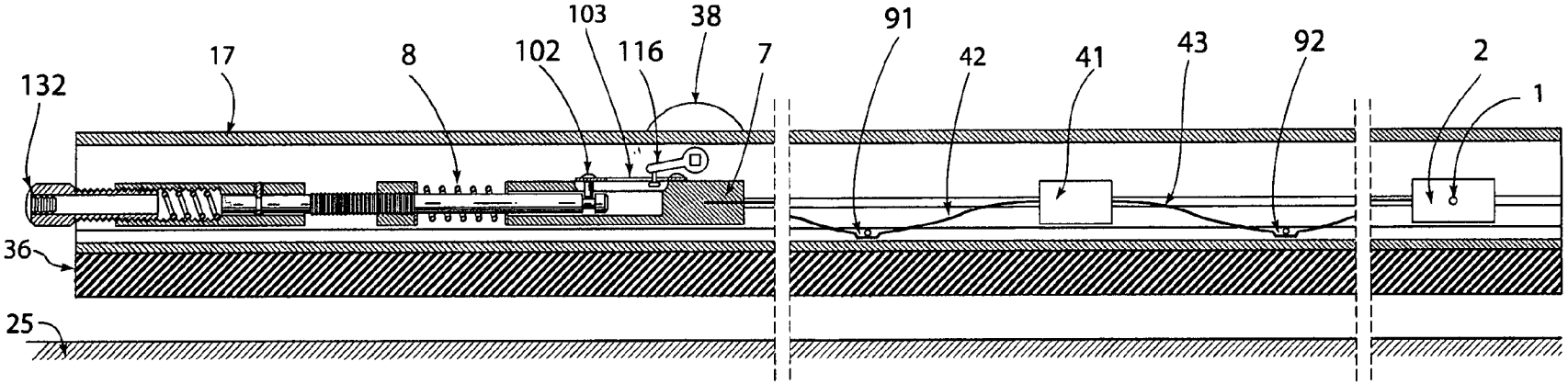
FIGS. 11, 12, 13, and 14 are front views of the first embodiment of the invention showing four successive operating stages, in which the seal is lowered from its retracted to its extended position and returned to its retracted position.

At operating stage one with the door open, sealing member 36 is retracted inside channel 15, cushion 132 is not engaged with jamb 26, and shaft 10 is latched to housing 7 by means of latch pin 102. Rocker 116, is engaged in slot 103*b* of leaf spring 103. The condition of stage one is shown in FIG. 11.

Figure 12:
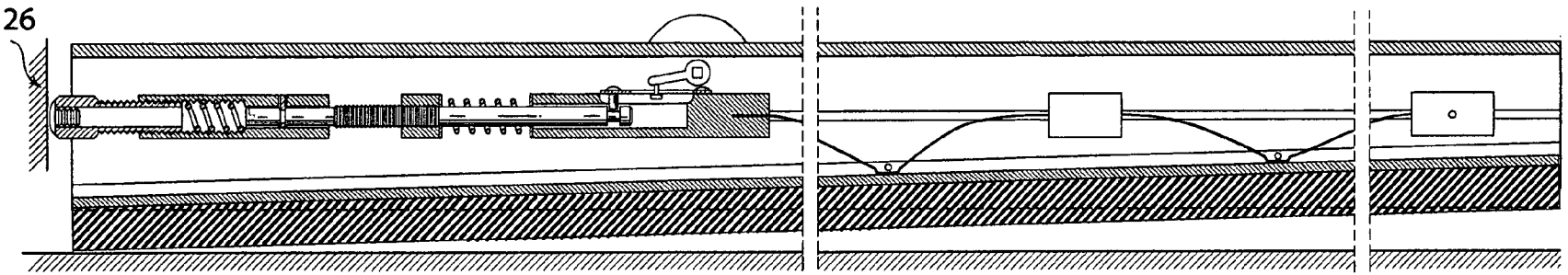

As the door is closed, at one point cushion 132 will engage door jamb 26 at the hinged side of the door and cause block 7 to move to the right as the cylinder 131 is pushed into channel 15. At first, due to its lower spring constant leaf spring 42 will flex down (as seen in FIG. 12), and bring sealing member 36 at coupling point 91 downwardly until sealing member 36 contacts with door sill 25. Housing 7 moves along the channel to the right in the figure, causing rocker 116 to slide along the slot of spring 103 closer to latch pin 102. FIG. 12 shows the condition of Automatic Door Bottom in stage two.

Figure 13:
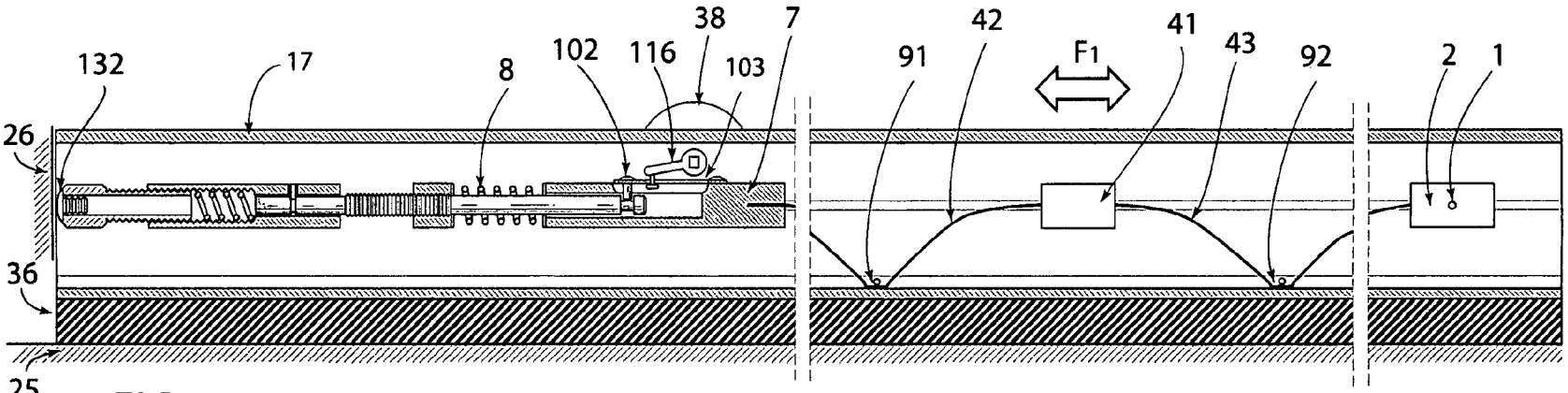

A further closing of the door 21 causes rocker 116 to move more closely to latch pin 102. Such further closing also causes spring 43 to flex and bring the remaining part of sealing member downwardly by applying a downward force at coupling point 92, until the door is completely closed and sealing element is fully in contact with door sill 25. Springs 42 and 43 as combined have a spring tension force F1 as shown in FIG. 13.

Figure 14:
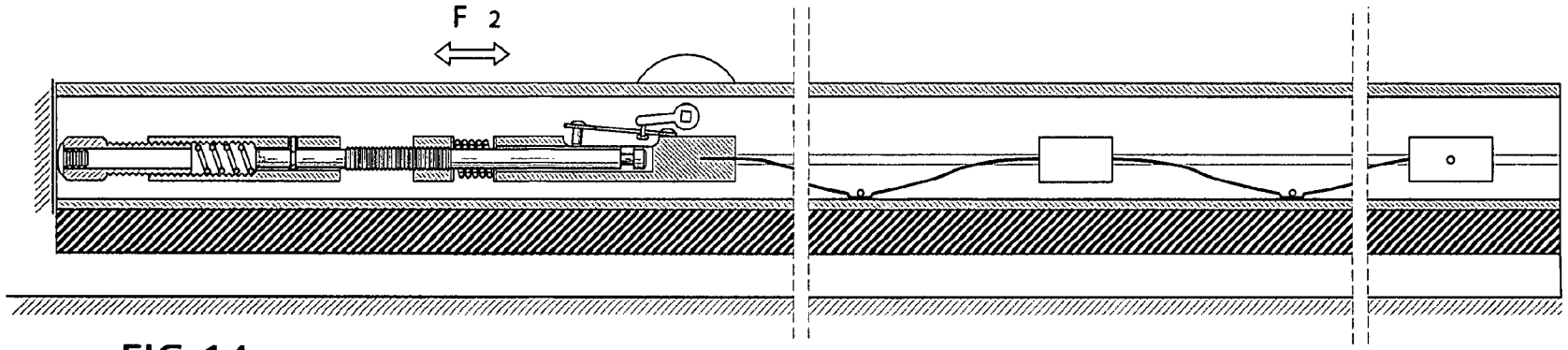

In accordance with the present invention the action of operating either one of the levers 38 cause rocker 116, in cooperation with leaf spring 103, to release the latch pin 102 from latching onto shaft 10. The combined spring force F1 then causes springs 42 and 43 to unflex, causing housing 7 to move to the left side as seen in FIG. 14, and in turn depress helical spring 8. Since the spring constant of helical spring 8 is designed to be significantly smaller than spring constant of leaf spring 43, the net result will cause sealing member 36 to retract significantly into the channel 15. Spring 8 will eventually compress and has spring tension or force F2 which is significantly smaller than F1.

When the door 21 is eventually reopened, tension F2 of helical spring 8 would push shaft 10 out of housing 7 until it is latched again by latch pin 102. This effectively resets the release mechanism 9 and sets the condition of the Automatic Door Bottom to the stage one of operation as shown in FIG. 11.

According to this embodiment of the invention, stages one, two, and three are normal operation stages for the Automatic Door Bottom with release mechanism. Operation stage four is optional and active only if release mechanism 9 is actuated by a user.

Figure 15:
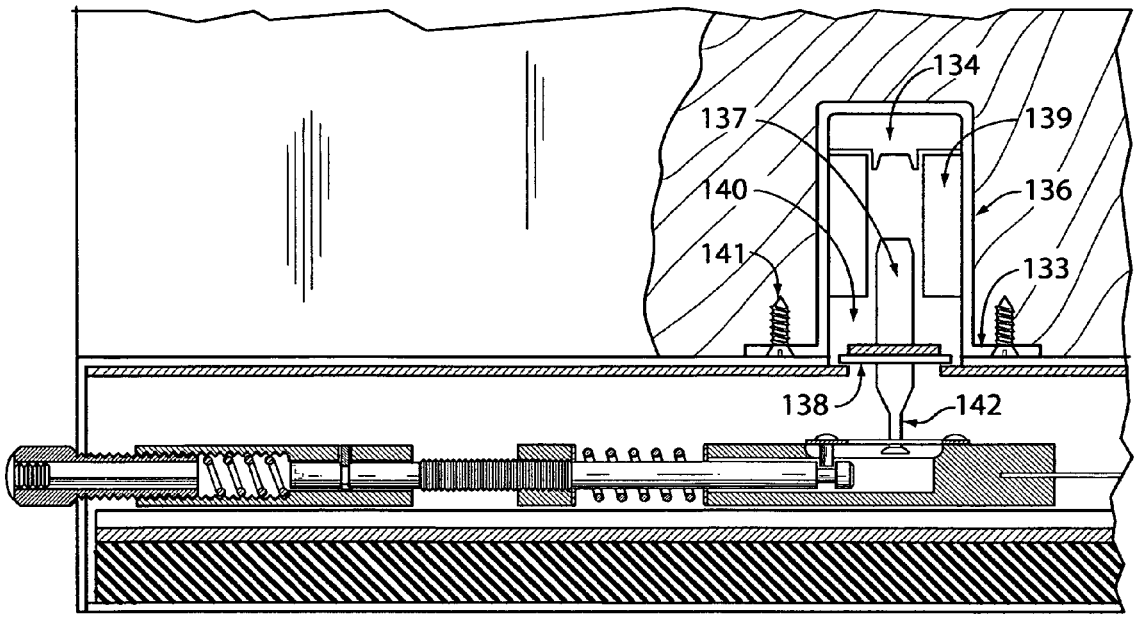
FIG. 15 is an elevation view of a modified version of the embodiment of FIG. 1 showing a solenoid as the actuator for the release mechanism.
Figure 16:
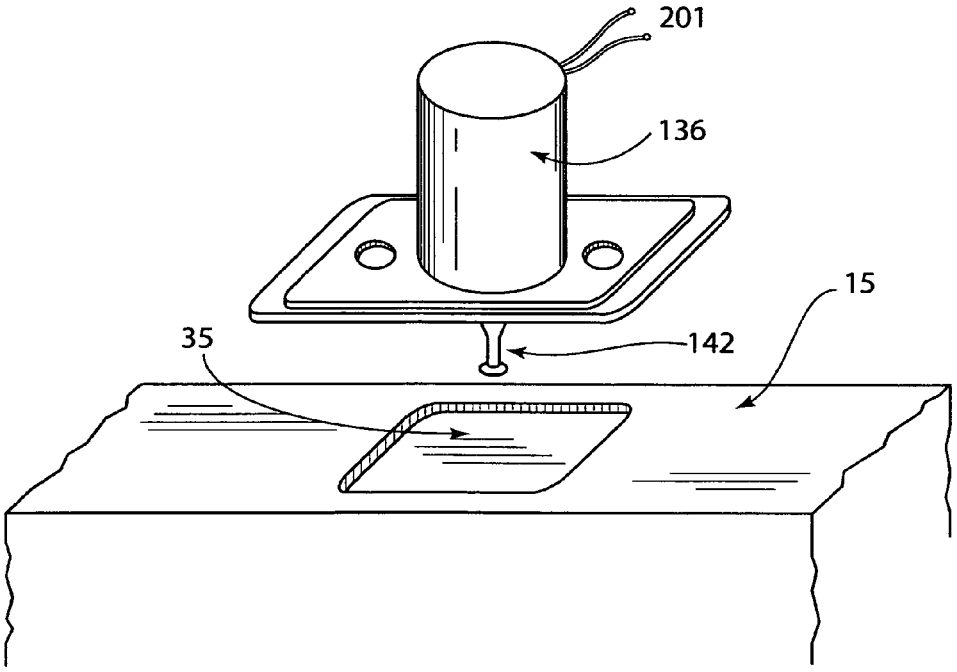
FIG. 16 is a perspective view of the solenoid of FIG. 15.

The release mechanism 9 can furthermore be actuated by another means. FIGS. 15 and 16 show one alternative of actuating the release mechanism by means of a solenoid. This actuating mechanism is preferable for an Automatic Door Bottom 22 mortised mounted to the bottom of door 21 similar to the mounting shown in FIG. 9.

The solenoid consists of: a frame 136, a mounting plate 133, a plunger 137 with a washer 138, E-ring 140, end stop 134, and coil 139. The mounting plate 133 is mounted into the mortised part of door upward with mounting screws 141. The plunger 137 projects into the channel 15 at an opening 35 on the top wall 17. A hook 142 at the end of plunger 137 is slidably engaged into slot 103*b* of leaf spring 103, by a method similar to insertion of rocker 116 to spring 103 in FIG. 6.

An action of energizing coil 139 will cause a pulling action by plunger 137, and actuate the release mechanism 9. This action can be done by means of a switch that temporarily connects the coil 137 to any suitable source of electricity energy for example a battery. Furthermore the switch can be related to an action of turning the door knob 31 (as in FIG. 1), for example by installing a switch that can be activated by rotation of the door knob. The suitable source of electricity and means to activate the switch are well known to persons skilled in the art.

Figure 17A:
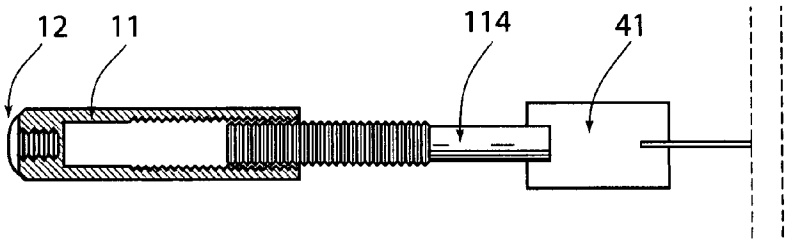
FIGS. 17*a*, 17*b*, and 17*c* together form a partial front view of a displacement mechanism according to the second embodiment of the invention.
Figure 17B:
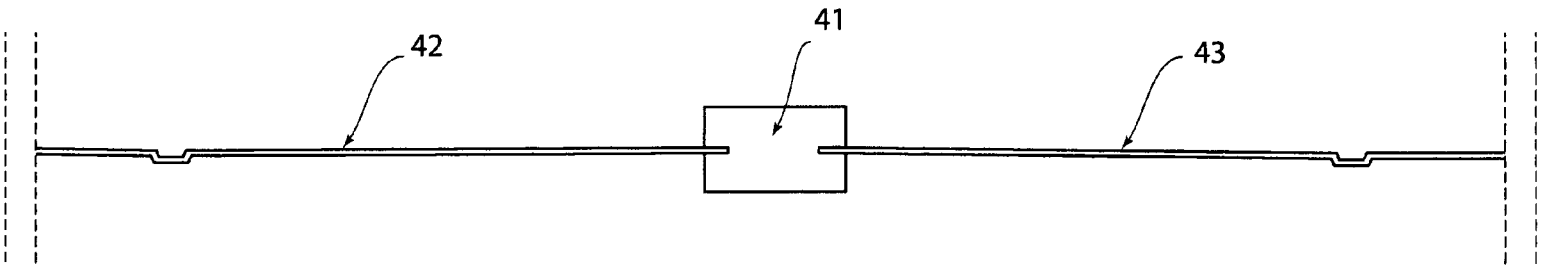
Figure 17C:
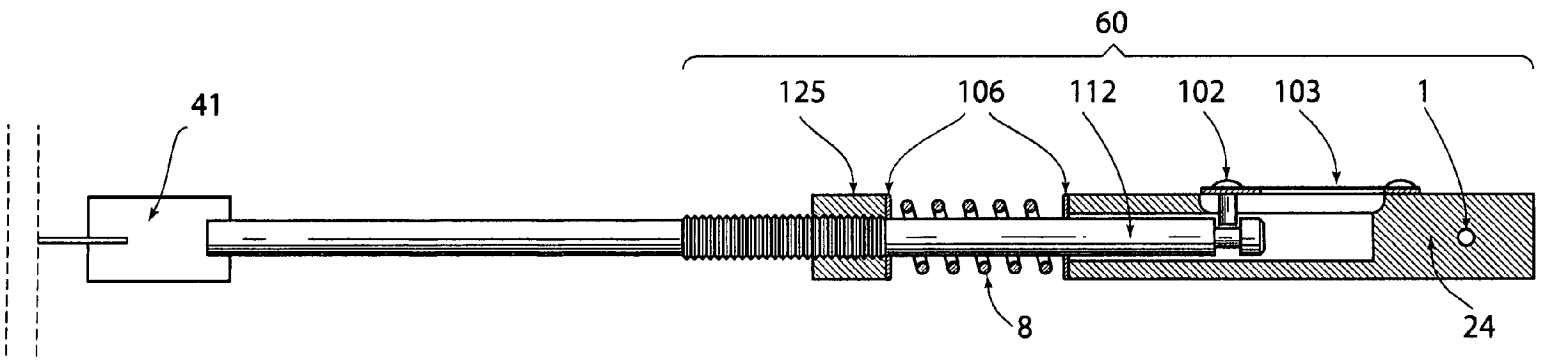

FIGS. 17A, 17B, and 17C show partial front views of a displacement mechanism according to the second embodiment of the invention. To form a complete figure, join the right side of FIG. 17A to the left side of FIG. 17B, and likewise join the right side of FIG. 17B to the left side of FIG. 17C.

The release mechanism of this embodiment is referred to by numeral 60 and resembles the release mechanism 9 with several exceptions. Housing 24 resembles housing 7, with the exception that housing 24 has a termination hole 1. Shaft 112 is similar to shaft 10, with the exception that shaft 112 does not have screw head 50 and grove 51. Housing 24 is fixably mounted at hole 1 to channel 15 by means of mounting means similar to mounting means for end block 2 as described above with respect to FIG. 4.

Adjustment nut 11 with cushion 12, is used to adjust the effective length of operation of the displacement mechanism by rotating it on the threaded end of shaft 114.

Figure 18:
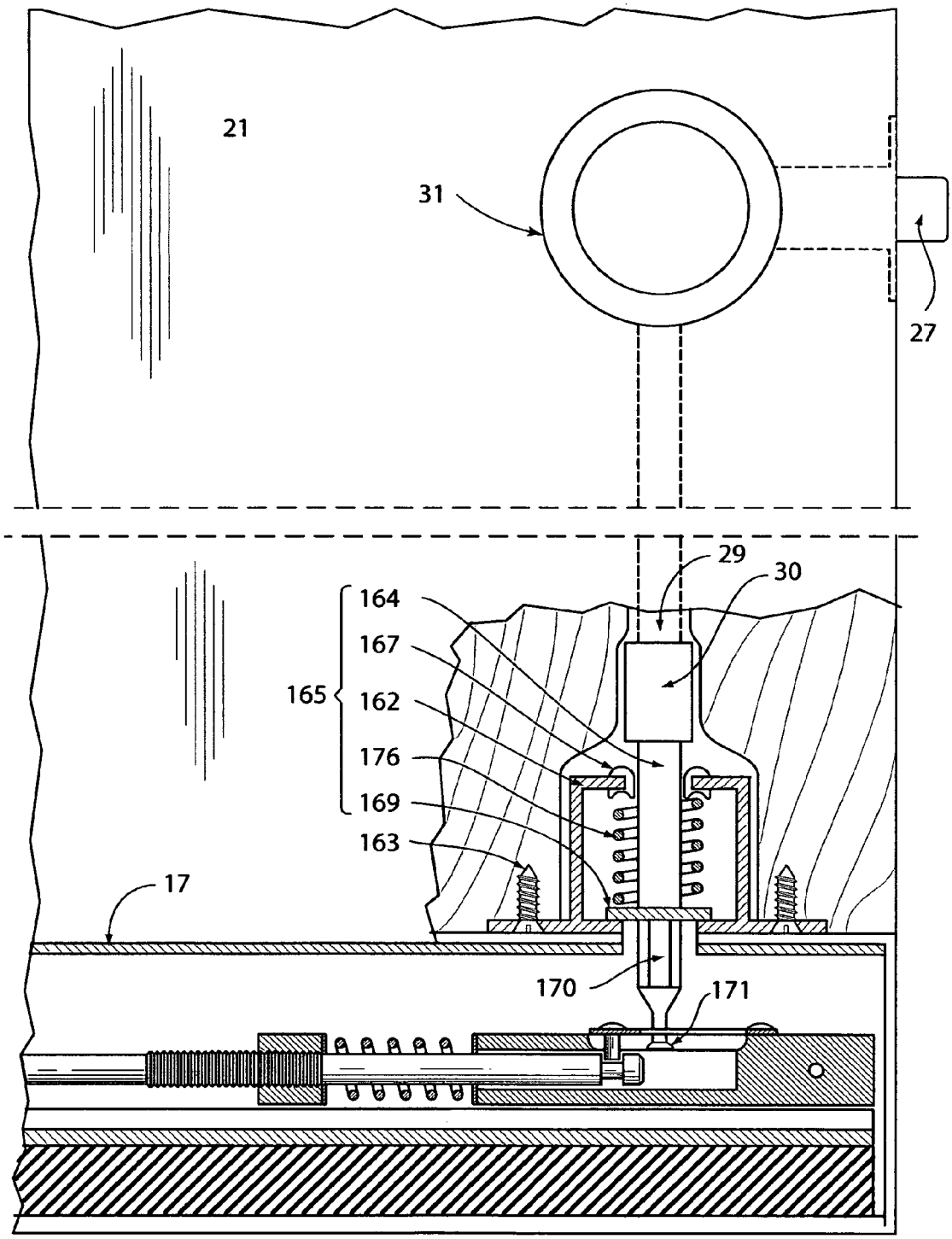
FIG. 18 is a front view of the bottom part of the unhinged side of a swing door, showing a door knob as an actuator for the release mechanism.

FIG. 18 shows an alternative actuating mechanism for this embodiment using the operation of door knob 31. The actuating mechanism consist of an adapter 28 (not shown in this figure) and an actuator 165. The actuator has a housing 162 mounted in the bottom surface of door 21 by mounting screws 163. The actuator consists of a shaft 164 having a threaded top end and a hexagonal shaped bottom 170. The end of bottom 170 is provided with a hook form 171. The hook 171 is slotted into slot of leaf spring 103. The shaft is suspended at the lower part with washer 169 and a helical spring 176. Its upper part passes through a sleeve 167 mounted in housing 162. At the top most part of shaft 164, it is connected to shaft 29 by shaft connector 30. The actuator 165 is operable by knob 31 through adapter 28.

Figure 19:
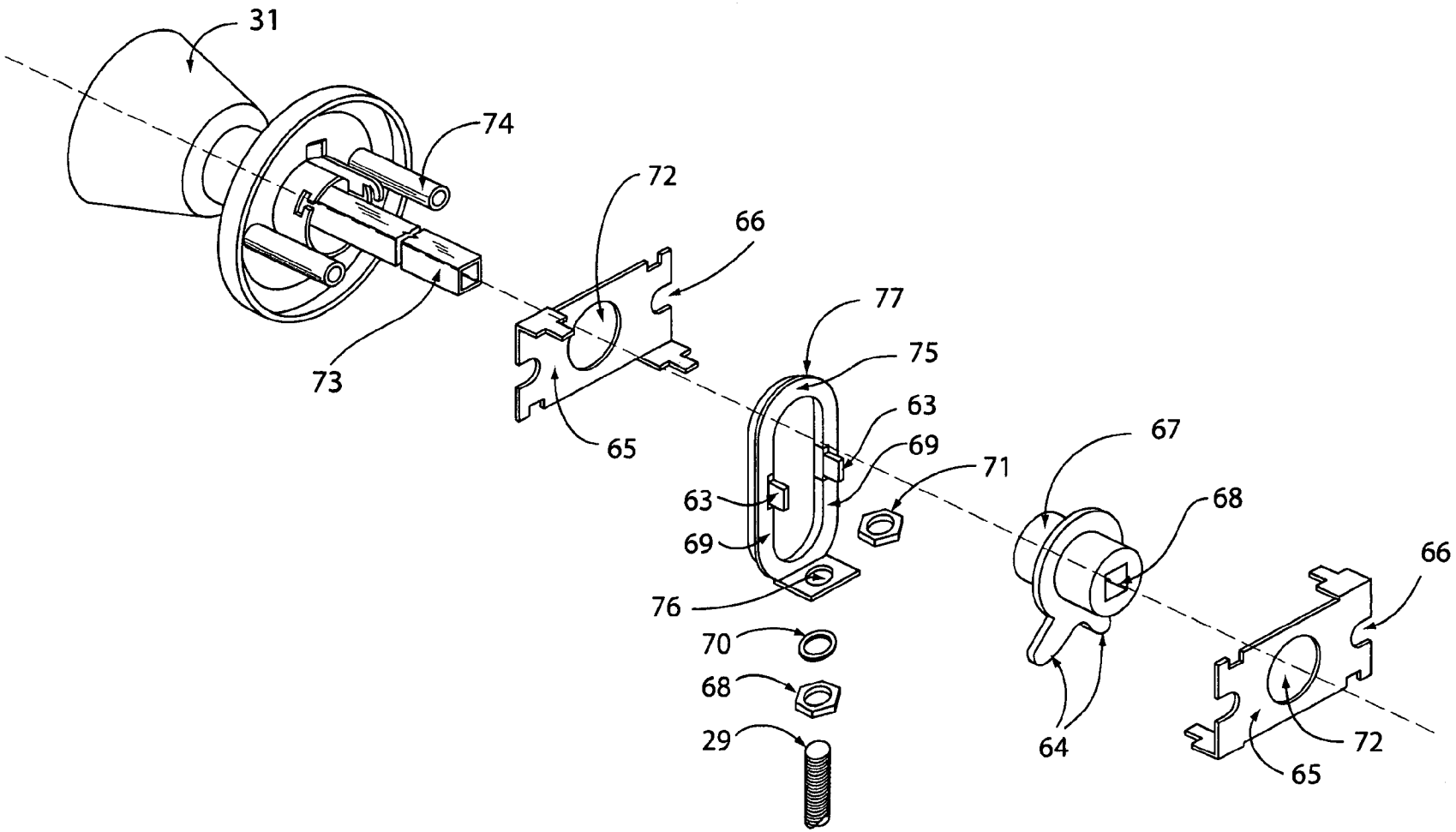
FIG. 19 is a detailed perspective view of the door knob adapter used in the embodiment of FIG. 18.
Figure 20:
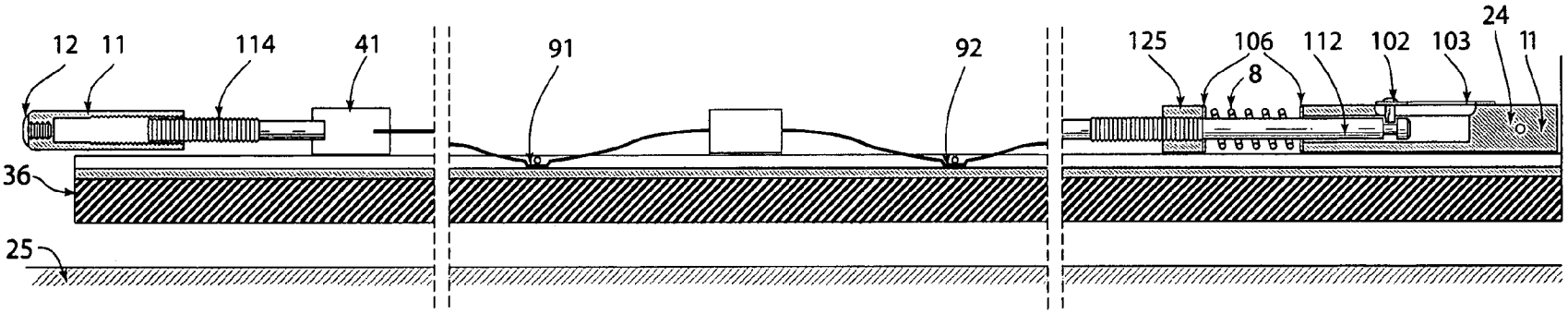
FIGS. 20, 21, 22, and 23 are front views of the second embodiment of the invention, showing the four successive operating stages.

Adapter 28 can be constructed similar to U.S. Pat. No. 6,030,008. An adaptation of the patent to fit this invention is shown in FIG. 19.

A pair of fastening plates 65 are provided with confining holes 66 and holes 72. Confining holes 66 are confined into alignment rods 74. Into holes 72 a rotary wheel 67 is provided with a through hole 68 and two moving teeth 64 engagable with projections 63 of two action arms 69. The moving teeth 64 of rotary wheel 67 are actuated by door knob 31, which is engaged with the through hole 68 by mean of spindle 73, thereby causing the moving teeth to pull up either of the projections 63, depending on the action of operation of the door knob. As it is seen from the side of door knob 31 in the figure, an action of turning the knob clockwise causes moving teeth 64 to move counterclockwise and engage with right hand side of action arm 69. And vise versa, an action of turning the knob 31 counterclockwise, cause moving teeth 64 turn clockwise and engage with left hand side of action arms 69.

A body 77 is provided at its lower end with an attachment hole 76 and a collar 75 at its upper end. The attachment hole 76 is provided for connection to shaft 29. The shaft 29 is fastened to hole 76 by nuts 71 and slip ring 70. The collar 75 rests on one side of rotary wheel 67.

A spring loaded door latch 27 as shown in FIG. 18 is operable by the door knob 31 in a way that it is mutually exclusive from adapter 28.

The operation of this actuating mechanism from turning of door knob 31, creates a pull-up action by shaft 29, connector 30, shaft 164, and hook 171. A cooperation of sleeve 167, helical spring 176, and washer 169 will push the hook 171 down, to reset the pull-up action by operation of actuation.

FIGS. 20, 21, 22, and 23 show respectively operating stages one, two, three and four according to the second embodiment of the invention. Stage one represents the condition or position of the Automatic Door Bottom with a door in an open position, stage two represents its position with the door in an almost closed position. Stage three represents the position or condition of the Automatic Door Bottom with the door in its closed position, and stage four represents its condition with the door in its closed position and with the release mechanism activated.

Figure 21:
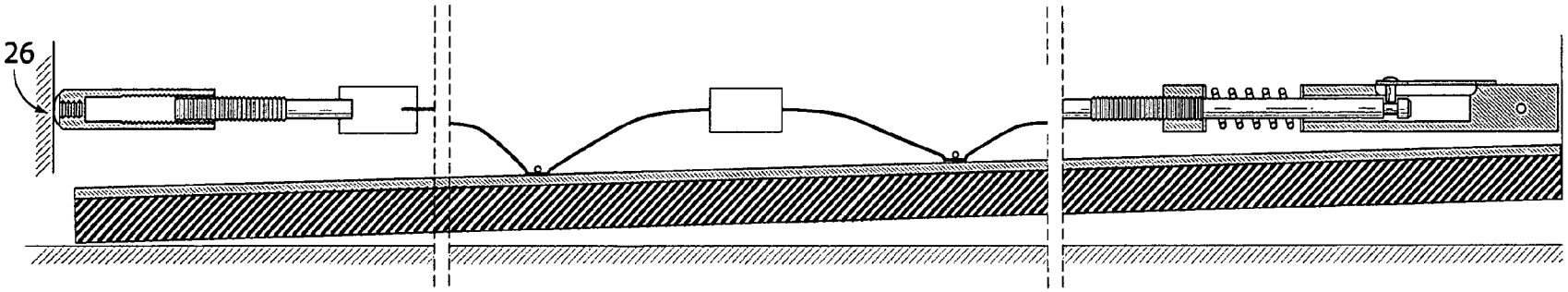

As door 21 is closing, cushion 12 engages with jamb 26 causing spring 42 to flex and its associated sealing member 36 at the hinged side of the door to move downwardly until contact is made with sill 25, as is shown in FIG. 21.

Figure 22:
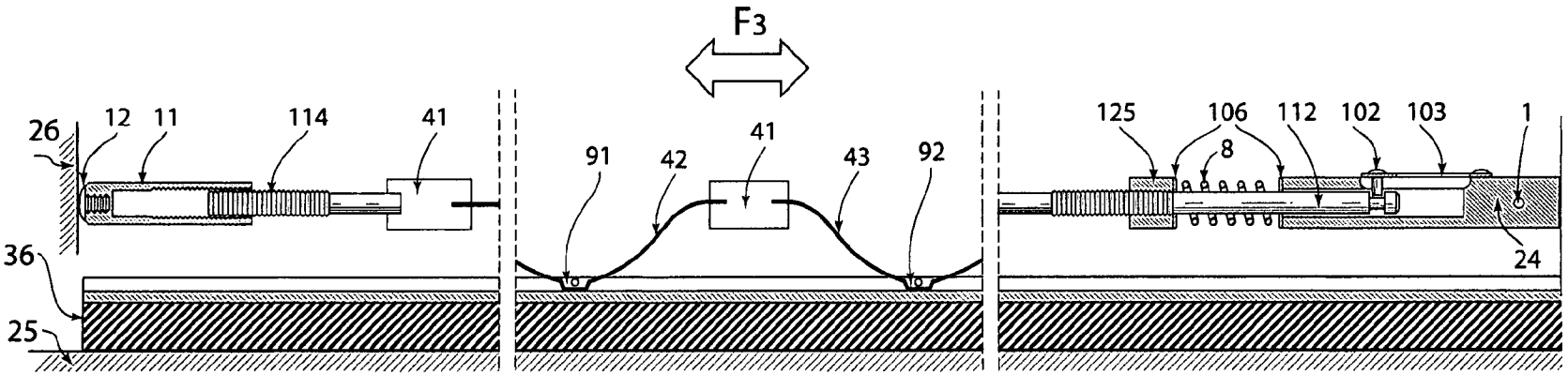

A further closing of door 21 will flex spring 43 and cause the sealing member 36 at the unhinged side of the door to come to contact sill 25 until the sealing member is completely in contact with sill 25 and door 21 is completely closed, as shown in FIG. 22. Springs 42 and 43 will retain a combined spring force F3.

Figure 23:
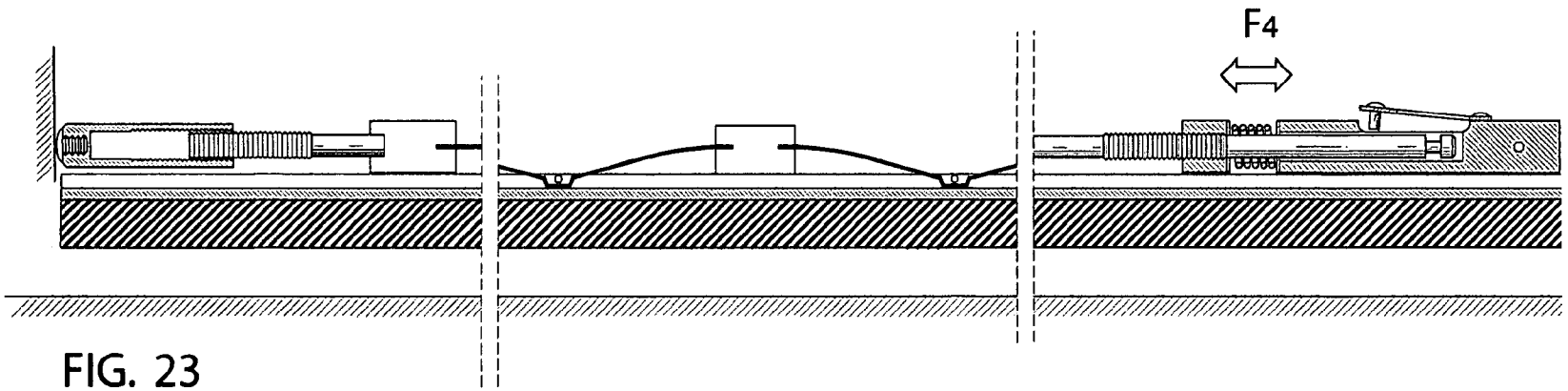

With an actuation mechanism similar to that described with respect to FIGS. 18 and 19, the action of turning the door knob 31, would activate release mechanism 165. As result latch pin 102 releases the shaft 112 causing helical spring 8 to be depressed by force F3, and eventually retain force F4. The sealing members as significantly retracted into the channel 15, as shown in FIG. 23.

According to this actuation mechanism stage one, two, three and four are normal routine stages of operation of the Automatic Door Bottom. The action of turning door knob 31 will actuate the release mechanism and a precursor to open the door 21, or it can be an action just to actuate the release mechanism 60 without actually opening the door.

Furthermore, alternatives to actuate the release mechanism can be by means of mechanical lever as shown in FIG. 5, or by means of solenoids as shown in FIGS. 15 and 16.

The Automatic Door Bottom 22 according to the second embodiment can be surface mounted similar to FIG. 3, or it can be flush mounted similar to FIG. 8.

Figure 24A:
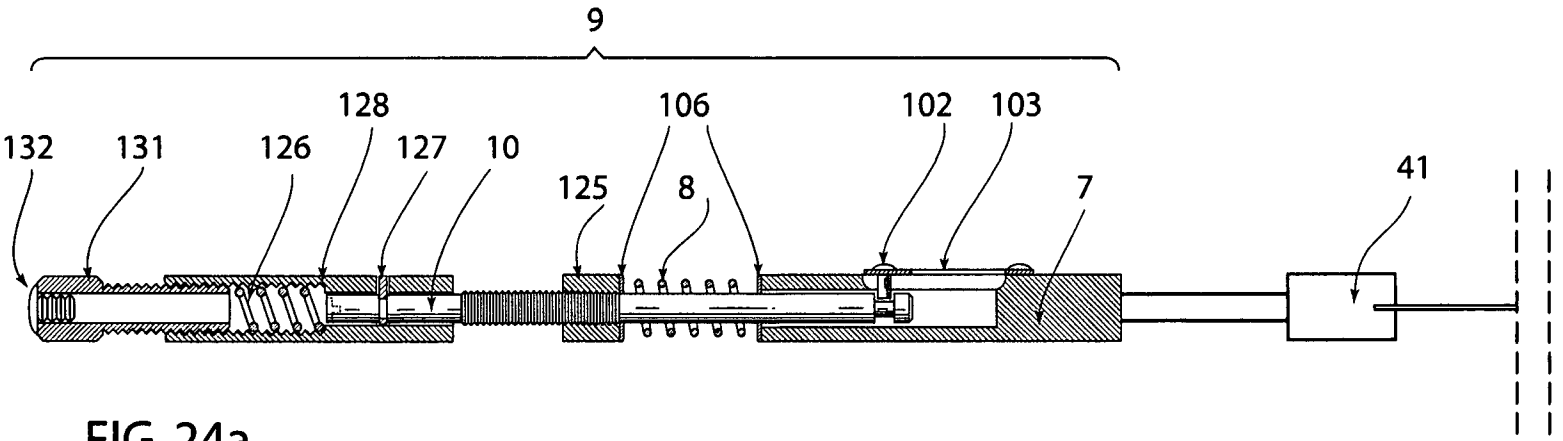
FIGS. 24*a* and 24*b* together form a front view of a displacement mechanism according to a third embodiment of the invention.
Figure 24B:
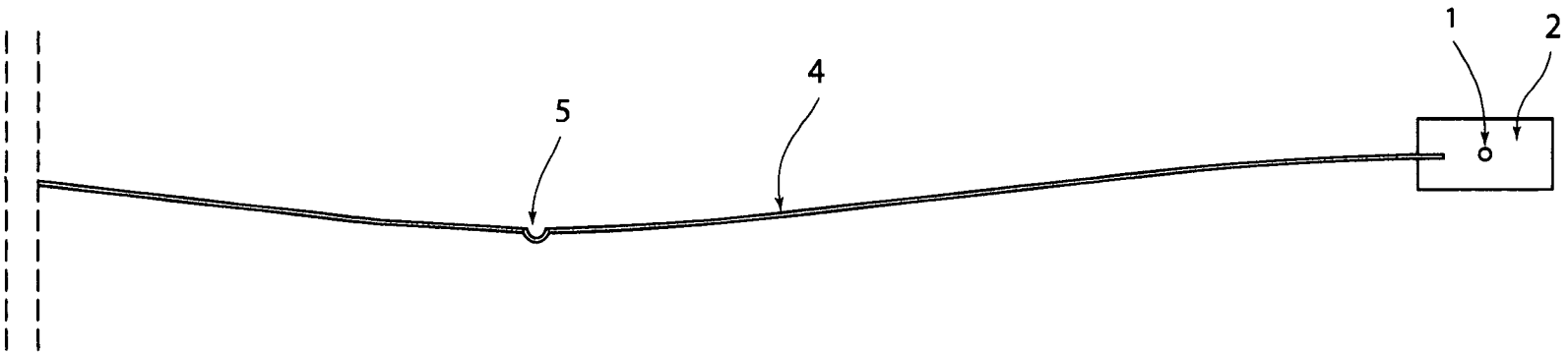

FIGS. 24*a*, 24*b* show partial views of the displacement mechanism with release mechanism according to the third embodiment of the invention. To form a complete figure, join the right side of FIG. 24A to the left side of FIG. 24*b*. FIG. 24A is the same as FIG. 10A, with one exception, that it is connected to a connecting block 41. The description of FIG. 24*a* otherwise follows the same description for FIG. 10*a*.

Figure 25:
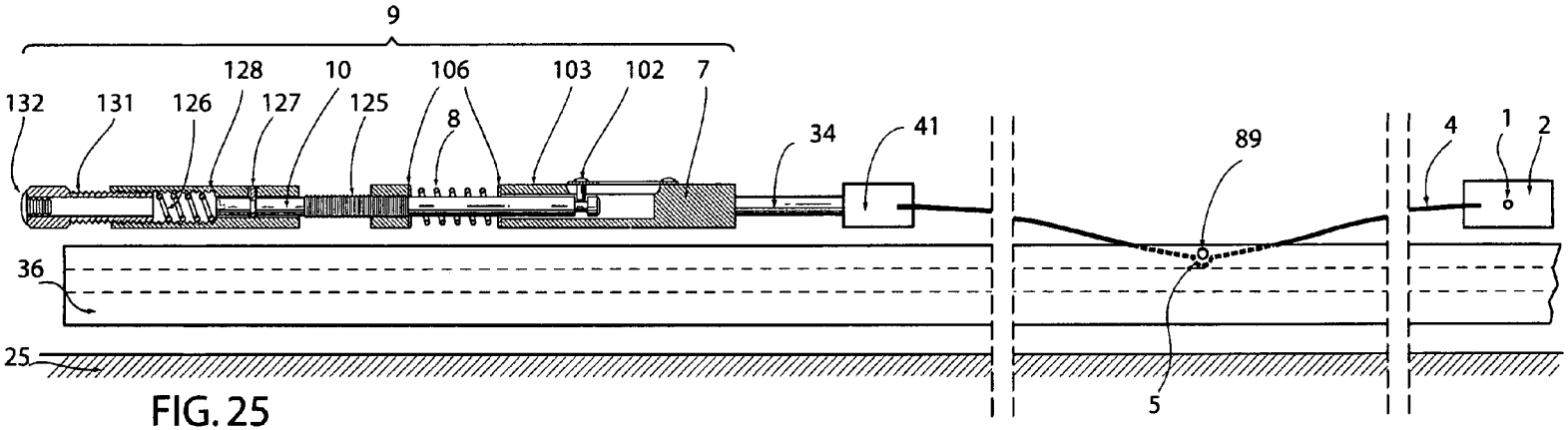
FIGS. 25, 26, and 27 are front views of the third embodiment of the invention, showing its three successive operating stages.

The end block 2 is fixed to channel 15 by similar means as shown in FIG. 6. Housing 7 is connected with shaft 34 to connecting block 41 which in turn is connected to leaf spring 4. As shown in FIG. 25 a dimple 5 is coupled to sealing members 36 at in line holes at the rigid member 13 by means of pin 89. This coupling restricts any lengthwise movement of sealing element 36. The spring constant of leaf spring 4 is provided to be significantly larger that spring constant of helical spring 8.

Figure 26:
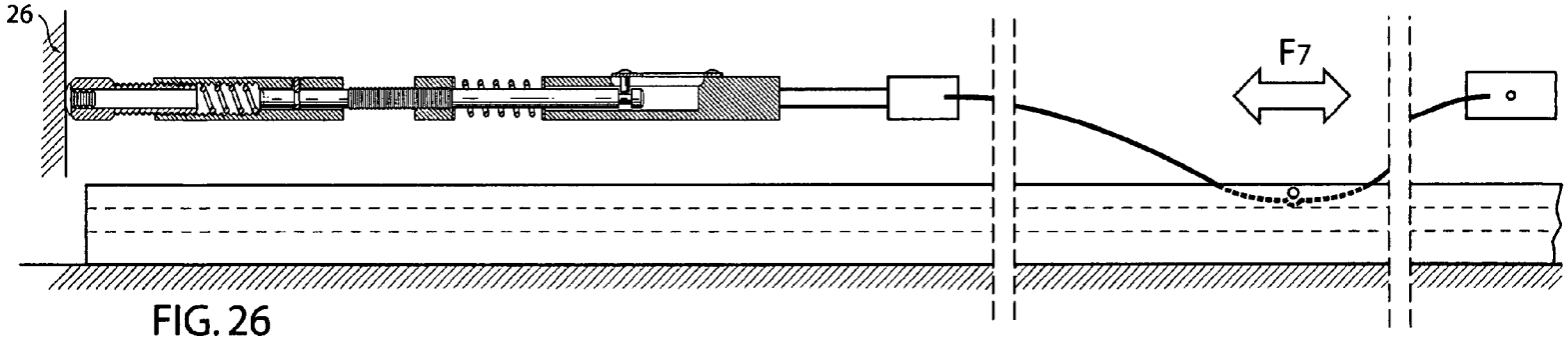
Figure 27:
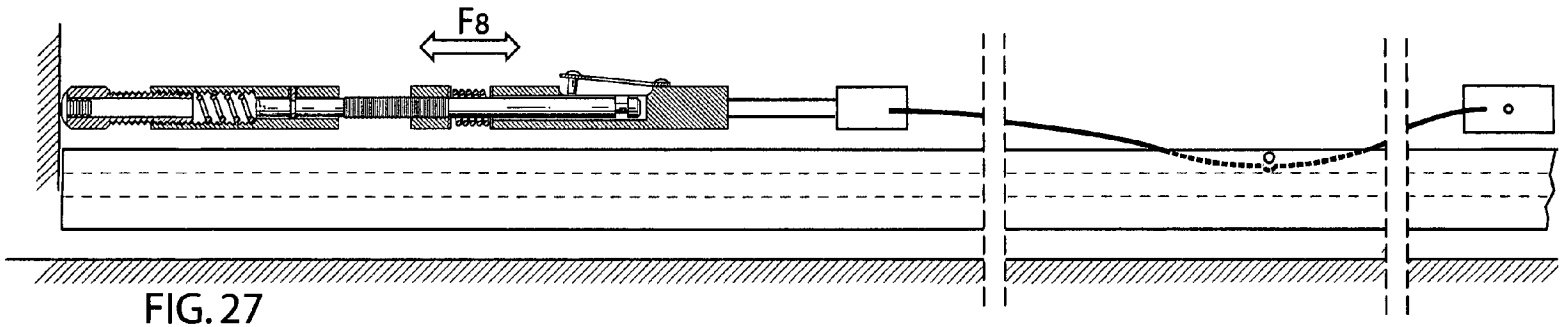

FIGS. 25, 26, and 27 show respectively operating stages one, two, and three according to the third embodiment of the invention. Stage one represents the condition of the Automatic Door Bottom with a door in its open position, stage two represents the condition with the door in its closed position. Stage three represents the condition with the door in closed position but with the release mechanism activated.

During closing of the door 21, at one point, cushion 132 will engage with jamb 26 causing the release mechanism to be driven into channel 15 along rails 18. That movement causes spring 4 to flex, forcing sealing members 36 partially out of the lower section of the channel 15 until it contacts with door sill 15. The location of the spring dimple 5 is arranged such that the portion of sealing member 36 from the coupling point toward the hinged side of the door is relatively longer than the portion of member 36 from the coupling toward the unhinged side. This arrangement is to assure that the portion of the sealing element 14 near the hinged side will contact the sill first, to minimize drag of sealing element 14 against the sill 25 during closing of door 21. FIG. 26 shows the second operating stage. Spring 4 will retain a spring force F7. An activation of release mechanism by means of actuation as described in FIG. 5, 15, or 18 will cause shaft 10 to unlatch to housing 7, and spring 8 to be depressed and eventually retain force F8. F8 is significantly smaller than F7. FIG. 27 shows the third operating stage of the Automatic Door Bottom according to the third embodiment of the invention where door 21 is closed and sealing member 36 is retracted into channel 15. When the door 21 is opened, cushion 132 disengages from jamb 26 and relieves pressure to shaft 10. Retained force F8 would cause the spring to spring and to pull shaft 10 out of housing 7 until its annular grove is latch again by latch pin 102. The release mechanism 9 is thus reset.

All publications, patents, and patent documents are incorporated by reference herein, as though individually incorporated by reference. Although the invention has been described with reference to a specific and preferred embodiment and technique, it should be appreciated by one of skill in the art that many variations and modifications may be made within the scope of this invention.

While the above invention has been described with reference to certain preferred embodiments, the scope of the present invention is not limited to these embodiments. One skilled in the art may find variations of these preferred embodiments which, nevertheless, fall within the spirit of the present invention, whose scope is defined by the claims set forth below.

What is claimed is:

1. An automatic door bottom for use with a door having a bottom edge and adapted to be pivotally mounted on a door jamb for movement between a closed position wherein the door is positioned over a sill and an open position wherein the bottom edge of the door is not over said sill, said automatic door bottom comprising:

a sealing member having a length corresponding to a width of said door;

means for mounting said sealing member on said door for movement with the door between said closed position and said open position;

a sealing member displacement device responsive to said movement of the door from the open position toward the closed position to move said sealing member from a first, retracted, position downwardly to a second, extended sealing position relative to the sill when the door is in the closed position, the downward movement of the sealing member beginning at an end of the sealing member adjacent a side of the door which is mounted on said door jamb;

said sealing member displacement device including at least one elongated resilient member engaging said sealing member, said resilient member applying a force downwardly on the sealing member to urge the sealing member toward the second sealing position when the door is in the closed position;

release means for releasing the sealing member displacement device when the door is in the closed position which allows the resilient member to move said sealing member from said second sealing position vertically upward into the first retracted position relative to the sill;

said release means including a latching means for selectively latching the displacement device in a first condition which allows the displacement device to move the sealing member between said first retracted and second extended positions during the movement of the door between the open and closed positions and for releasing the displacement device which allows the displacement device to assume a second condition which allows the resilient member to move the sealing member from said second sealing position to said first retracted position while the door is in the closed position without need for opening the door;

said sealing member displacement device also including a) a rigid member having opposed ends, one of which is positioned to engage the door jamb and is on the side of the door which is mounted on said jamb and the other end having a groove therein and b) a housing having a bore hole formed therein slidably receiving said other end of the rigid member and an opening formed in the housing communicating with said bore hole to allow engagement of said groove of rigid member and said latching means; means disposed between said rigid member and said housing for urging said rigid member toward an extended position, said latching means is engaged in the groove of the rigid member when said latching means latches said displacement device in said first condition; said housing being engaged with said at least one elongated resilient member to deform the at least one elongated resilient member when the door is in the closed position and the displacement device is in said first condition, the deformation of the elongated resilient member causes the elongated resilient member to apply the downward force on the sealing member to urge the sealing member toward the second extended sealing position; said release means releasing the displacement device when the door is in the closed position and the latching means latches the displacement device in said first condition by disengaging the latching means from the groove of the rigid member.

2. An automatic door bottom as in claim 1 wherein, said rigid member has a threaded surface, said means for urging said rigid member toward the extended position is a coil spring, said sealing member displacement device includes an adjustment block threadably engaging said threaded surface of said rigid member, and said coil spring is located between the adjustment block and the housing.

3. An automatic door bottom as in claim 1 wherein, said release means is located adjacent a side of the door opposite the side of the door mounted on said door jamb.

4. An automatic door bottom as in claim 1 wherein, said release means includes means for operatively connecting the latching means to a door knob on the door and for causing rotational movement of the door knob to move the latching means out of engagement with the groove of the rigid member of the sealing member displacement device when the latching means latches said displacement device in said first condition.

5. An automatic door bottom as in claim 1 wherein, said release means includes an electronically operated solenoid.

6. An automatic door bottom as in claim 1 wherein said latching means includes a vertical latch and a means for biasing the vertical latch toward the groove of the rigid member, said release means including means for moving the vertical latch vertically against the bias of said means for biasing the vertical latch to move the vertical latch out of engagement in the groove of the rigid member when the latching means latches the displacement device in said first condition.

7. An automatic door bottom as in claim 1 wherein, said release means includes a lever rotatably mounted on the door, wherein a rotational movement of the lever moves the latching means out of engagement with the groove of the rigid member when the latching means latches the displacement device in said first condition.

8. An automatic door bottom as in claim 1 wherein said latching means includes a latching member within said sealing member displacement device, wherein said means for urging said rigid member toward the extended position allow for an elongation of said at least one elongated resilient member even when the door is in the closed position.

9. An automatic door bottom as in claim 1 further comprising a thermal sensor.

10. An automatic door bottom as in claim 1 wherein said at least one elongated resilient member comprises a plurality of elongated resilient members, one of which is adjacent the side of the door which is mounted on the door jamb, and said one of said elongated resilient members having a lower resistance to bending than each of the other said elongated resilient members.

11. An automatic sweep for a door having a bottom edge and being movable between an open position and a closed position, the automatic sweep comprising:

an elongated seal member adapted to be coupled to the bottom edge of the door for movement between a raised position and a lowered position relative to the bottom edge of the door; and a seal member displacement device responsive to the movement of the door between the open position and the closed position to move the seal member between said raised position and said lowered position, comprising: a) an elongated operating element that extends generally parallel to and above the seal member and is longitudinally displaceable between first and second positions corresponding respectively to the open and closed positions of the door;

b) means for coupling said operating element with the seal member and for translating said longitudinal displacement of the operating element into the movement of the seal member between said raised and lowered positions, and c) means for co-operation with a stationary abutment which defines an opening to be closed by the door, wherein said co-operation means engages the stationary abutment and moves said elongated operating element from said first position to said second position as the door moves from said open position to said closed position thereby moving the seal member from said raised position to said lowered position, said co-operation means disengaging from the stationary abutment as the door is moved from said closed position to said open position which allows said coupling and translating means to move said operating element from said second position to said first position which moves said seal member from said lowered position to said raised position; and release means for releasing said operating element to allow said coupling and translating means to move the seal member from said lowered position to said raised position when the door is in said closed position and without opening the door; said release means including latching means for latching the operating element to said co-operation means such that said operating element will move the seal member between said raised and lowered positions upon the movement of the door between said open and closed positions and for unlatching the operating element from said co-operation means which allows the coupling and translating means to move said operating element from said second position to said first position which moves said seal member from said lowered position to said raised position even when the door is in the closed position.

12. An automatic door bottom for use with a door having a door bottom portion and being adapted to be pivotally mounted on a door jamb to allow the door to move between a closed position wherein the bottom portion of the door is positioned over a sill and an open position wherein the bottom portion of the door is not over the sill, said automatic door bottom including:

a door seal housing having an open bottom side, said door seal housing being adapted to be mounted on the door with the open bottom side of the door seal housing facing downwardly, a door seal member mounted in the housing for movement between a first retracted position wherein the door seal member is substantially completely within the housing and a second extended position;

a displacement assembly in the housing which contacts the door jamb to move the seal member from said first position to said second position as the door is moved from said open position to the closed position and which disengages from the door jamb to allow the seal member to move from said second position to said first position as the door is moved from said closed position to the open position, said displacement assembly having first and second ends, said first end positioned to extend beyond the housing for contacting the door jamb as the door moves from said open position to said closed position and the displacement assembly including a jamb contact surface on said first end of the displacement assembly and including at least one elongated resilient member having first and second ends, said first end of the elongated resilient member being fixed to said housing; said elongated resilient member extending longitudinally above the seal member and being secured thereto between the first and second ends of the elongated resilient member to apply a force to the seal member to move the seal member from the first, retracted, position to the second, extended position when the door is moved from said open position to said closed position;

a release assembly, connected between the second end of the displacement assembly and the second end of the elongated resilient member;

said release assembly including a block slidably mounted in the housing and having a bore hole formed therein slidably receiving the second end of the displacement assembly, said block connected to the second end of the elongated resilient member, said second end of the displacement assembly having a recess formed therein;

said release assembly also including a spring biased latch for engagement in said recess in the second end of the displacement assembly, when said latch is engaged in said recess, said displacement assembly and said resilient member move together during movement of the door between said open and closed positions such that as the door is moved from said open position to said closed position, the contact surface of the displacement assembly contacts the door jamb causing the displacement assembly to move causing the second end of the resilient member to move toward the first end of the resilient member and flex the elongated resilient member to move the seal member from the first retracted position to the second extended position, and as the door is moved from the closed position to the open position, the displacement assembly disengages the jamb allowing the second end of the elongated resilient member to move away from the first end of the resilient member which moves the seal member from said extended position to said retracted position;

said release assembly further including means for selectively disengaging the spring biased latch from the recess in the second end of the displacement assembly when the door is in said closed position such that when said latch is disengaged from the recess and the door is in said closed position, the block slides relative to the second end of the displacement assembly toward the first end of the displacement assembly to allow the first and second ends of the elongated resilient member to move apart and move the seal member from said extended position to said retracted position when the door is in said closed position.

13. An automatic door bottom as defined in claim 12 wherein a spring is connected between the block of the release assembly and the first end of the displacement assembly to return the recess in the second end of the displacement assembly into engagement with the latch as the door is moved from said closed position to said open position.

14. An automatic door bottom for a hinged door having a bottom portion, the door being pivotable between an open position and a closed position, wherein the bottom portion of the door is positioned over a sill when the door is in said closed position, the door having a width dimension and a hinge edge, said hinge edge including means for pivotably mounting the door on a door jamb, said automatic door bottom comprising:

a sealing member having a length corresponding to the width dimension of the door and including a portion that is adjacent to the hinge edge of the door;

means for mounting said sealing member on the bottom portion of the door such that said sealing member moves with the door and is movable between an extended sealing position and a retracted position relative to said bottom portion;

a spring element responsive to the pivoting of the door between said open and closed positions and moving said sealing member vertically downward into said extended sealing position, as the door is pivoted from said open position to said closed position; and a release device which allows said spring element to move said sealing member vertically upward into said retracted position relative to the bottom portion when the door is in the closed position with the bottom portion positioned over the sill;

said release device including a) connection means for transferring the pivoting motion of the door between said open and closed positions to the spring element; and b) means for moving said connection means such that the connection means releases said spring element which allows said spring element to move the sealing member vertically upward into said retracted position relative to the bottom portion even when the door is in the closed position.

* * * * *